US008177568B2

(12) United States Patent
Junger

(10) Patent No.: US 8,177,568 B2
(45) Date of Patent: May 15, 2012

(54) ELECTRIC PLUG HAVING FUEL RETURN

(75) Inventor: Dieter Junger, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 144 days.

(21) Appl. No.: 12/673,250

(22) PCT Filed: Jul. 24, 2008

(86) PCT No.: PCT/EP2008/059687
§ 371 (c)(1),
(2), (4) Date: Feb. 12, 2010

(87) PCT Pub. No.: WO2009/021821
PCT Pub. Date: Feb. 19, 2009

(65) Prior Publication Data

US 2011/0212638 A1 Sep. 1, 2011

(30) Foreign Application Priority Data

Aug. 13, 2007 (DE) ..... 10 2007 038 139

(51) Int. Cl.
*H01R 4/60* (2006.01)

(52) U.S. Cl. ..... 439/190

(58) Field of Classification Search ..... 439/190, 439/352, 371; 239/89, 96, 533.5, 585.1–585.5
See application file for complete search history.

(56) References Cited

U.S. PATENT DOCUMENTS

| | | | | |
|---|---|---|---|---|
| 6,027,037 | A | 2/2000 | Murakami et al. | |
| 6,119,966 | A * | 9/2000 | Wagner et al. | 239/585.3 |
| 6,550,699 | B2 * | 4/2003 | Nagai et al. | 239/585.1 |
| 6,684,854 | B2 * | 2/2004 | Coldren et al. | 123/446 |
| 6,698,666 | B2 * | 3/2004 | Ohata et al. | 239/89 |
| 6,905,083 | B2 * | 6/2005 | Ricco | 239/533.2 |
| 7,334,570 | B2 * | 2/2008 | Klyza | 123/467 |
| 7,766,685 | B2 * | 8/2010 | Pabst et al. | 439/352 |
| 2008/0268694 | A1 | 10/2008 | Pabst et al. | |

FOREIGN PATENT DOCUMENTS

| | | |
|---|---|---|
| DE | 102 32 250 | 2/2004 |
| DE | 10 2004 055 297 | 6/2006 |
| EP | 0 844 385 | 5/1998 |
| WO | WO 01/18382 | 3/2001 |

* cited by examiner

*Primary Examiner* — Jean F Duverne
(74) *Attorney, Agent, or Firm* — Merchant & Gould P.C.

(57) ABSTRACT

The invention relates to a plug module (24, 124) for being received in an attachment component (10), which must be contacted at least electrically, particularly a fuel injector for installation in the cylinder head region of an internal combustion engine. Said engine is supplied with fuel via a fuel injection system, which has a low-pressure region. The plug module is a combined plug module (24, 124), which has a first plug part (26) for electrical contacting and a replaceable return component (38, 138) for a fluid to be removed from the attachment component (10).

10 Claims, 10 Drawing Sheets

Fig. 7.1
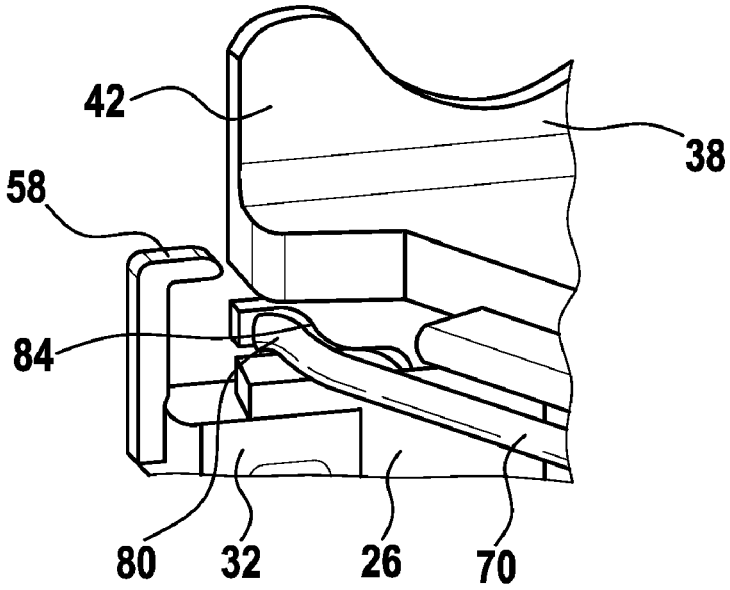
Fig. 7.2
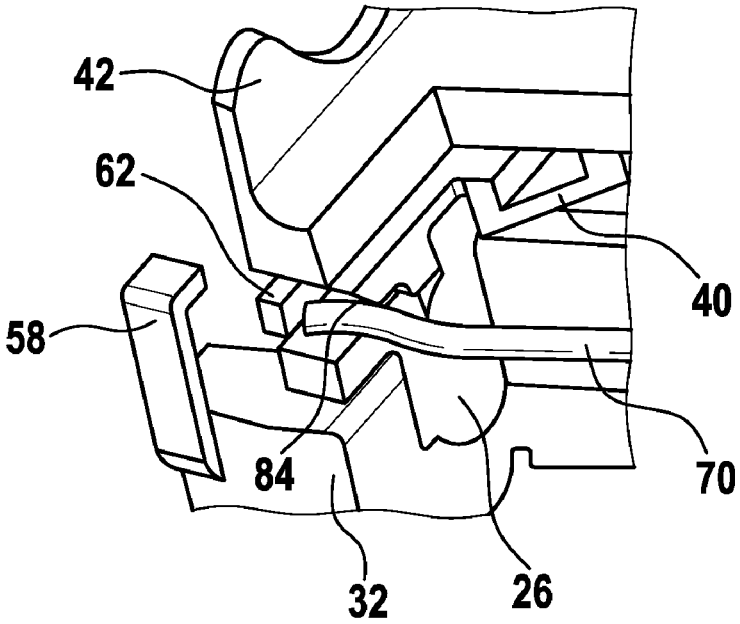

Fig. 10.1
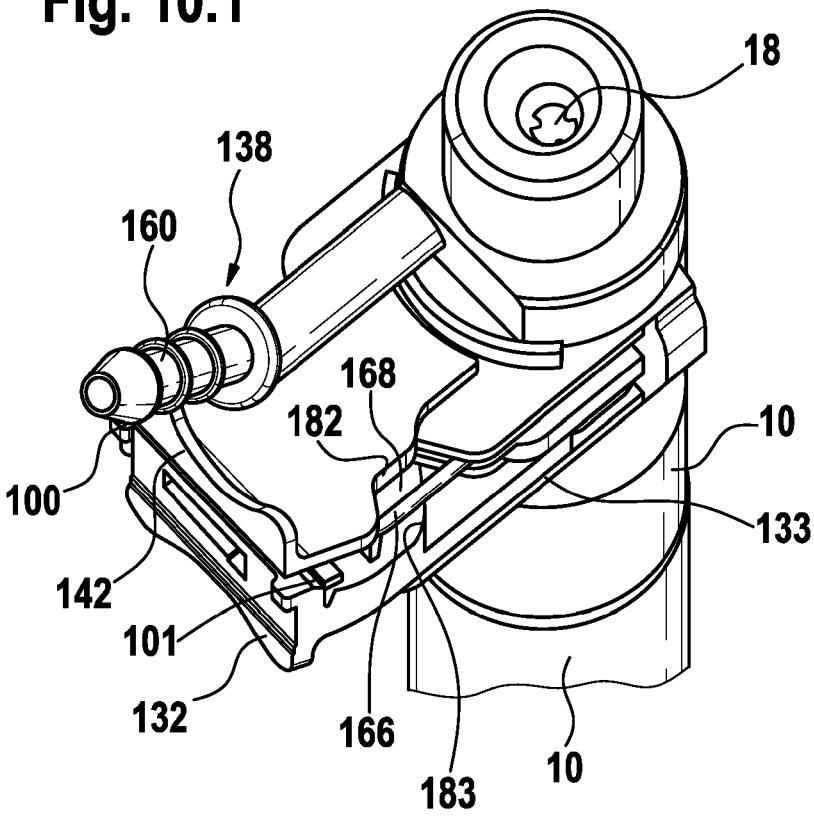
Fig. 10.2
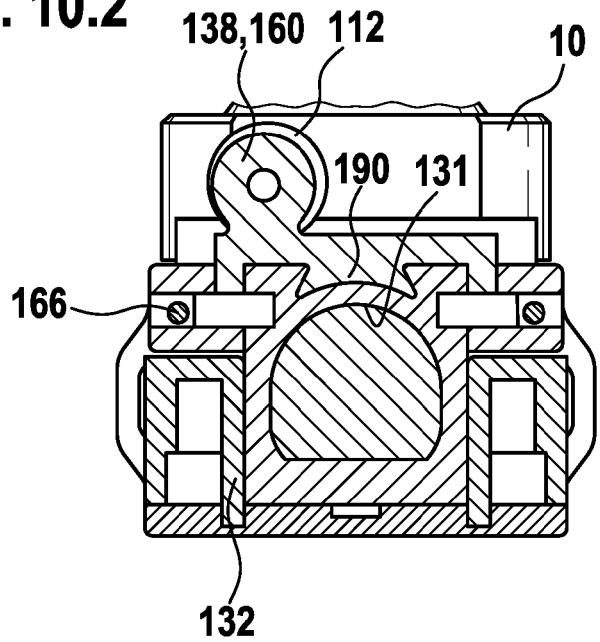

Fig. 11.1
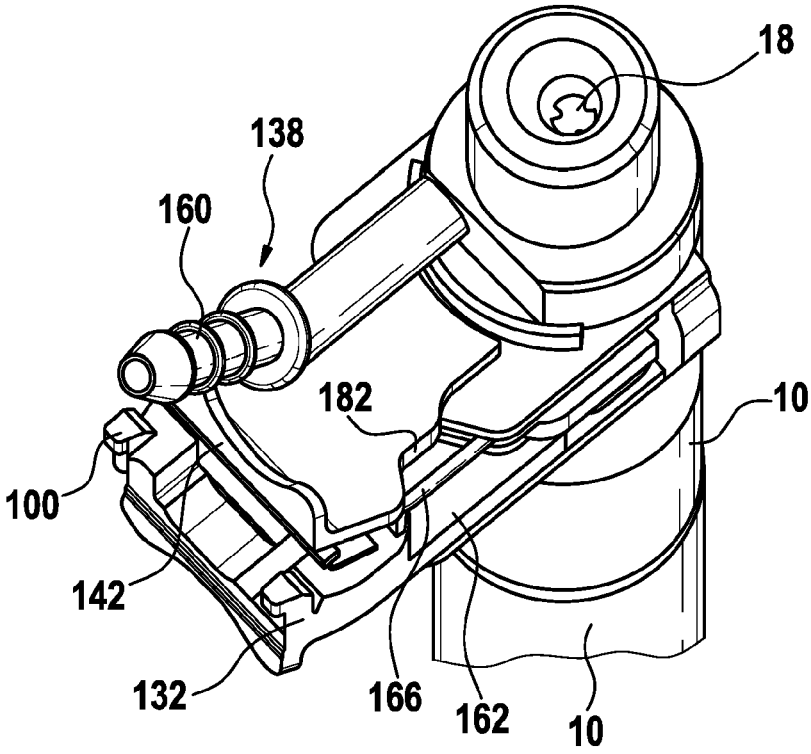
Fig. 11.2
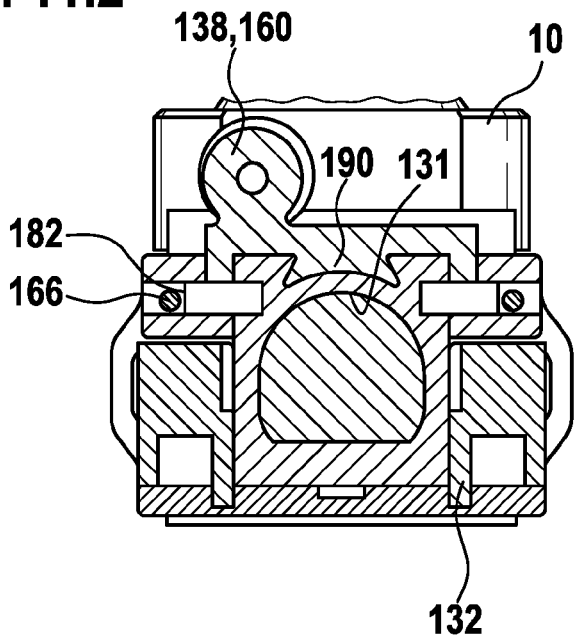

Fig. 12.1
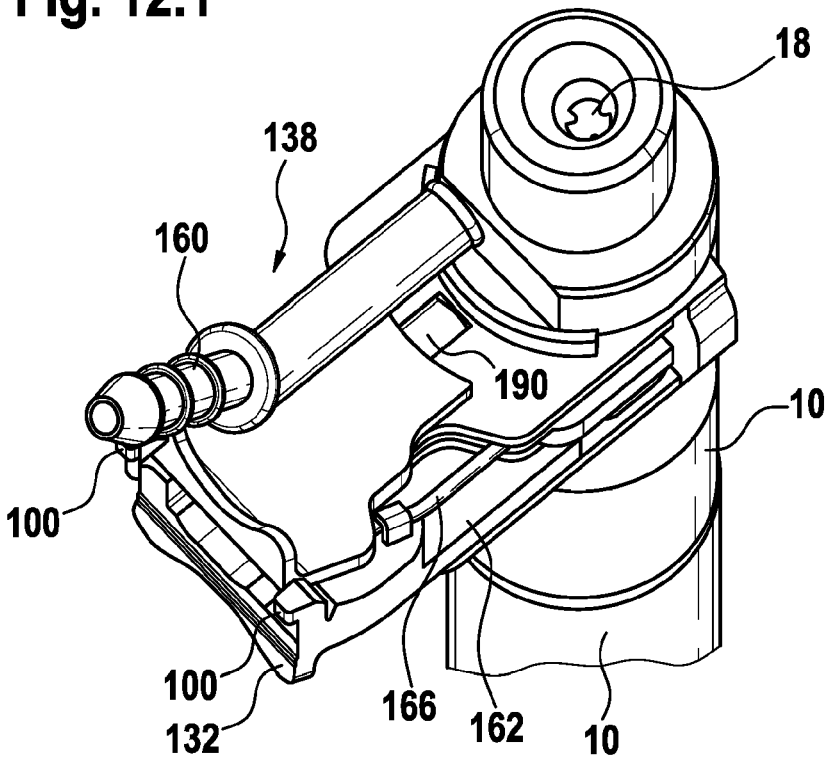
Fig. 12.2
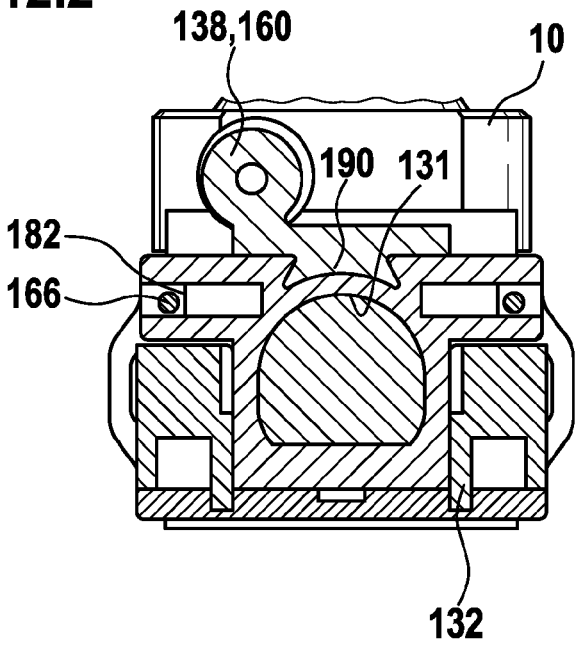

ELECTRIC PLUG HAVING FUEL RETURN

This application is a National Stage Application of PCT/EP2008/059687, filed 24 Jul. 2008, which claims benefit of Ser. No. 10 2007 038 139.7, filed 13 Aug. 2007 in Germany and which applications are incorporated herein by reference. To the extent appropriate, a claim of priority is made to each of the above disclosed applications.

TECHNICAL FIELD

Besides a high-pressure pump, a high-pressure accumulator body, unit injector units and the fuel injectors, plastic pipes are used in the return region for the fuel (i.e. on the low pressure side of the injection system) as a part of fuel injection systems like, for example, Unit Injector systems (UI) or also high-pressure accumulator injection systems (Common Rail). The fuel, as, for example, the de-energized control quantity within the fuel system or the leaked volume within said system, which accrues when the fuel injectors are actuated, is again carried back into the tank via these plastic pipes disposed in the low pressure region of the fuel injection system.

The pipes used within the low pressure region are generally preformed pipes from plastic, which due to the installation conditions often have a form deviating from a straight line and are bent in a curved fashion. Plastic molded pipes can have a form deviating from a straight line in relation to the inner contour and to an outer contour, which is independent of said inner contour and geometrically extends differently than the same. Plastic molded pipes, which carry fuel, must meet high strength requirements and furthermore demonstrate a high resistance to bursting in the case of an accident. The plastic molded pipes used in the return region on the low-pressure side of the fuel system can be manufactured with or without a flow control valve depending on the pressure to be maintained in the low-pressure region. Plastic molded pipes, which have a bend or an angulated section or the like, can not be molded or can only be molded in a relatively cumbersome manner due to their inner contour. An inner contour bent in a curved fashion can of course be molded; however a flanging radius cannot be formed. Furthermore, a surface free from burrs cannot necessarily be assured. In the case of fuel-conducting plastic molded pipes, which lie in the crash area and as a rule are manufactured from durable plastic, a risk of breakage remains, which increases with dropping temperatures, whereby the danger exists when outside temperatures are low that a plastic molded pipe of this kind will burst and fuel will escape into the surroundings.

The connection between the fuel injectors, which are implemented in series production—be it electromagnetic valve-actuated injectors or be it injectors actuated by a piezo-actuator—is electrically contacted via electrical plug connections and is configured by a fuel return connector between a collecting return line and the individual injectors. In the case of fuel injectors in use today, the fuel return connection is tightly formed on the retaining body via a final overmolding made from plastic. The firm fixation of the fuel return connection at the fuel injector makes reclamation of the individual parts: retaining body, actuator, return line and plug-in connector impossible. The German patent DE 10 2004 055 297 A1 shows a solution, wherein an electrical plug is directly plugged into the retaining body and sealed there. The German patent DE 10 2004 055 297 A1 further discloses a plug-in connector arrangement with a plug, which has first detent arms disposed parallel to the plug-in direction and a secondary locking device. The plug-in connector arrangement is furthermore fitted with a mating plug having a collar, behind which detent projections engage with the first detent arms in the plugged-in final position. The secondary locking device is released from a pre-engaged position by the mating plug during the insertion operation and upon achieving its undetented position is impeded by the first detent arms up until its detent projections engage behind the collars of the mating plug. The electrical contacting of a fuel injector is possible by means of the plug-in connector arrangement disclosed in the German patent DE 10 2004 055 297 A1.

SUMMARY

In light of the outlined technical field, the task underlying the invention is to create a combined plug module, which simultaneously on the one hand allows for an electrical contacting of an attachment component like, for example, a fuel injector of an internal combustion engine while taking into account restricted space conditions and on the other hand provides for the connectivity of the attachment component like, for example, a fuel injector to a part of a fuel injection system, in particular a return pipe.

According to the invention, a combined plug module is proposed, which allows for an electrical contacting and which, for example, is plugged into a locating bore, for example, into the retaining body, which is configured at 90E to the axis of the attachment component, in particular a fuel injector. In order to fix the plug part, which provides an electrical contacting of the attachment component, a retaining clip can, for example, be used, which is configured U-shaped and engages with detent-shaped projections configured on the circumference of the retaining body. On one side, preferably a flat side, in particular the upper surface, the plug body of the first plug part, which serves the purpose of electrically contacting the attachment component, has a linear guide, into which a return component, which is preferably configured as an injection molded part, is guided. This return component is preferably produced as an injection molded part and is connected to the fuel return, which is provided in the attachment component like, for example, a fuel injector. The return component can, for example, have a sealing element like, for example, an o-ring and return outlets, which during the course of the injection molding process can be molded in different angles of departure.

The return component, which is preferably produced as a plastic injection molded part, is mounted, for example, in a linear guide configured as a dovetail guide in particular on the upper surface of the body of the first plug part, which serves to electrically contact the attachment component. The return component has, for example, a flexibly configured, tongue-shaped detent mechanism on its lower surface. Said mechanism can be engaged with a detent projection beneath the linear guide on the upper surface of the plug body of the first plug part, which serves to electrically contact the attachment component. A protection of the plug body of the first plug part, which serves to electrically contact the attachment component, takes place via a slide displaceably mounted on the plug body of the first plug part, said slide being displaceable between a secured position and an unsecured position. The first plug part, which constitutes the electrical contacting of the attachment component, with the aid of the retaining clip is secured in its locked position by means of the component which is configured as a slide. At the same time, the slide, which is displaceably mounted on the first plug part with two retaining elements, takes over the securing of the fuel return element, which is guided on the upper surface of the first plug part and is configured in a replaceable manner.

The combined plug module according to the invention allows for the installation height to be reduced by the integration of the return component, which is attached to the low pressure region of the fuel injection system of the internal combustion engine, in such a way that the restricted installation conditions in the region of the cylinder head of internal combustion engines is taken into account. Due to the inventive guide and detent mechanism of the return component located on the upper surface of the first plug part, which serves to electrically contact the attachment component, additional fastening elements can be dispensed with for the fuel return in the attachment component, such as, for example, a fuel injector. By means of a positively controlled, incremental disassembly beginning with the detaching of the return element which is configured in a replaceable manner, fuel possibly escaping from said element cannot flow into the attachment component like, for example, a fuel injector and from there into the plug contact region. This results by virtue of the fact that said region is protected by the separate plug seal in the forward region of the first plug part. The electrical contacting and the connection of the fuel return with the fuel injection system can be implemented in one assembly operation with the combined plug module according to the invention. The variety of options and the flexibility with respect to attaching onto attachment components which are variously configured can be accommodated by virtue of the fact that the return component, which can be simply and cost effectively produced, can simply be replaced if, for example, other angles should be required with respect to the return pipe geometry.

DETAILED DESCRIPTION

Figure 1:
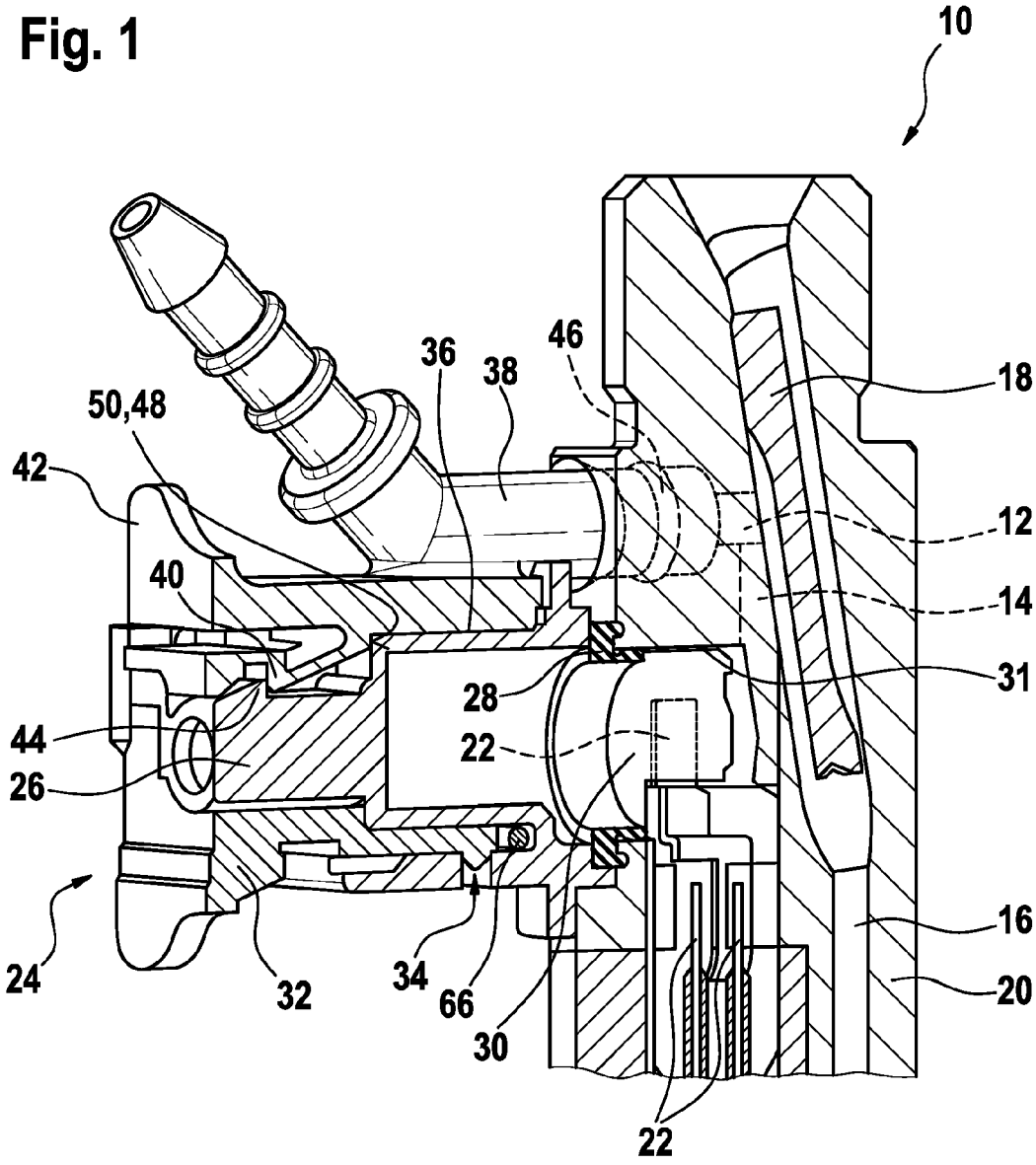
FIG. 1 is the plug module according to the invention with an electrically contacted attachment component and attached fuel return.

The combined plug module in the assembled condition on an attachment component of an internal combustion engine can be seen in the sectional depiction according to FIG. 1.

FIG. 1 shows that an attachment component 10 can, for example, be configured as a fuel injector, which comprises a return bore 12, which runs perpendicular to the axis of the attachment component 10. A leakage oil bore 14 opens out into the return bore 12 of the attachment component 10. Furthermore, an inlet bore 16 runs through the attachment component 10, which deals with a fuel injector according to the depiction in FIG. 1. A filter cartridge 18 is accommodated in the inlet bore 16. A peripheral surface of the attachment component 10, which deals with a fuel injector, is pointed out by the reference numeral 20. Electrical contacts 22, which in this instance are configured as tongue-shaped, are disposed within the attachment component 10. The electrical contacts serve to activate an actuator like, for example, a magnetic valve or a piezo-actuator for the actuation of a fuel injector. The electrical contacts 22 of the attachment component 10 are contacted via a combined plug module 24 which comprises a first plug part 26. The first plug part 26 forms a plug body, whereupon a plug seal 28 is mounted. Plug slots 30, via which the electrical contacts 22 of the attachment component 10 are electrically contacted, are configured on the end of the first plug part 26 which faces a plug bore 31 The plug bore 31 is sealed off from fuel and other mediums via the plug seal 28, whose diameter corresponds to the diameter of the plug bore 31 of the attachment component 10.

A slide 32, which is displaceable relative to the first plug part 26, is situated on the plug module 24 according to the sectional depiction in FIG. 1. The slide is displaceably mounted in the lower region of the combined plug module 24 according to the sectional depiction in FIG. 1.

The depiction according to FIG. 1 shows that the slide 32 in FIG. 1 assumes a secured position denoted by the reference numeral 34. In this state the slide 32 is inserted into the plug body of the first plug part 26 and secures it.

Reference numeral 31 denotes the plug bore 31, which is configured in the body of the attachment component 10—a fuel injector in the depiction according to FIG. 1. The plug bore 31 runs perpendicular to the axis of symmetry of the attachment component 10. It can furthermore be seen in FIG. 1 that the combined plug module 24 has besides the slide 32 and the first plug part 26 a return component 38, which is preferably produced in the course of the injection molding process, on an upper surface 36 of the first plug part 36. FIG. 1 shows that a connection piece branches off at an angle on the return component 38. A hose connection of a fuel return system on the low pressure side can, for example, be connected to said connection piece. Because the return component 38 depicted in FIG. 1 is detachably mounted on the upper surface 36 of the first plug part 26, said component 38 can be easily replaced. In the case of different required angle geometries, said component 38 can be replaced with respect to the connection piece with correspondingly differently configured return components 38. The return component 38 according to the depiction in FIG. 1 comprises a handle piece denoted with the reference numeral 42, whereat it can be moved relative to the upper surface 36 of the first plug part 26 of the combined plug module 24. The first plug component 38, which is produced in the course of the injection molding process, is preferably detached from the upper surface 36 of the first plug part 26 of the combined plug module 24.

In the assembled state of the combined plug module 24, which is depicted in FIG. 1, a sealing element 46, which is mounted on the pin of the return component 38 and is designed as an o-ring, is inserted into the return bore 12 of the attachment component 10 and seals the return bore 12 off to prevent fuel leakage. At the same time, it can be seen in the depiction according to FIG. 1 that the first plug part 26 of the combined plug module 24 contacts the electrical contacts 22 of the attachment component 10 in the plug bore 31. The electrical contacting of the electrical contacts 22 of the attachment component 10 occurs concurrently, simultaneously with the sealing off of the return bore 12 by the o-ring 46 of the return component 38.

It can furthermore be seen in the depiction according to FIG. 1 that a detent projection 40 is configured on the lower surface of the return component 38, which is preferably produced in the course of the injection molding process, The detent projection 40 is engaged with, i.e. fixed to, a detent projection 44 on the upper surface 36 of the first plug part 26 of the combined plug module 24. Moreover, it becomes apparent from the depiction according to FIG. 1 that the return component 38, which is preferably produced in the course of the injection molding process, is fixed by the detent projection 40, which is engaged with the detent projection 44 of the first plug part 26, to the upper surface 36 of the first plug part 26. In the fixed state of the return component 38 of the combined plug module 24, which is depicted in FIG. 1, stop faces 48 respectively 50 of the first plug part 26 and the return component 38 lie in contact with each other.

It can be seen from FIG. 1 that the return bore 12 preferably runs parallel to the plug axis of the first plug part 26 so that a common assembly, i.e. a common insertion of the return component 38, respectively of the first plug part 26, into the respective corresponding bores 12, 31 of the attachment component 10 is assured during assembly of the combined plug module 24 according to the depiction in FIG. 1.

The return pin bore preferably has a lateral offset chosen so that the return bore runs coaxially to the return pin bore and so that a connection with little offset to the leakage oil bore can be configured. As a result, the return bore and the return pin bore can be manufactured in a single operation with simultaneous low burr formation at the borehole cut.

FIG. 1 further shows that the slide 32 is locked in a secured position 34. For this purpose, a nose on a lug of the slide 32 catches in an opening at the bottom of the first plug part 26 of the combined plug module 24. The first plug part 26 of the combined plug module 24 is locked in the secured position 34 because a forward edge of the slide 32 pushes on a retaining clip 66, with whose help the combined plug module 24 is engaged with the attachment component 10, such as, for example, a fuel injector, in the region of the cylinder head.

Figure 2:
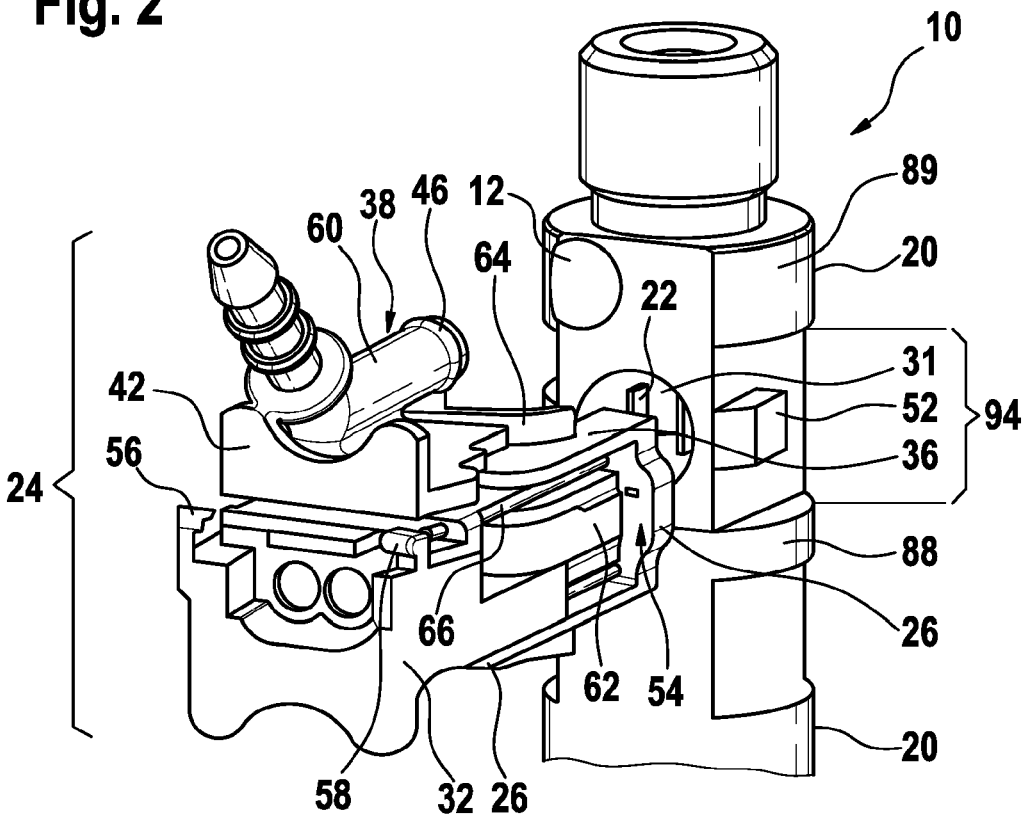
FIG. 2 shows assembly preparation of the combined plug module according to the invention for fastening to the retaining body of a fuel injector.

A preparation for assembling the combined plug module according to the invention to an attachment component, which relates to a fuel injector, can be seen in FIG. 2.

FIG. 2 shows the combined plug module 24, which comprises the first plug part 26 with the return component 38, which is slid thereon, and the slide 32, which is relatively movable on the first plug part 26. As can be seen in FIG. 2, a pin 60 of the return component 38, on which an o-ring 46 for sealing off fuel leakage is situated, and the front end—not depicted in FIG. 2—of the first plug part 26 of the combined plug module 24 are inserted into the return bore 12 as well as the plug bore 31. The insertion of the first plug part 26 into the plug bore 31, respectively of the pin 60 into the plug bore 12, occurs at the same time during the mounting of the combined plug module 24 into the openings 12 respectively 31, which run axially parallel to each other, in the attachment component 10. After inserting the first plug part 26 of the combined plug module 24, the electrical contacts 22 (cf. depiction according to FIG. 1), which run inside the attachment component 10, are electrically contacted. At the same time, the return bore 12, into which the leakage oil bore 14 opens out according to the depiction in FIG. 1, is connected to a return of a fuel injection system, which is not depicted in FIG. 2 by means of the return component 38, respectively the pin 60 with the o-ring 46 mounted thereon.

FIG. 2 shows that a retaining clip 66 is mounted on the first plug part 26 of the combined plug module 24. The forward regions of the retaining clip 66, i.e. on the end of the first plug part 26 that faces the attachment component 10, are engaged by securing lugs 62 of the slide 32. In the assembly region of the combined plug module 24 to the attachment component 10, said component 10 has at least one detent projection 52. The at least one detent projection 52 is configured in a lateral flattening portion on the attachment component 10 above a lower bottom shoulder 88, which is configured on the peripheral surface 20 of the attachment component 10. It can be seen from the depiction according to FIG. 2 that the combined plug module 24 is mounted via the first plug part 26 to the mutually opposed detent projections 52 on the peripheral surface 20 of the attachment component 10 between the collars 88, 89. FIG. 2 shows that a first retaining projection 56 as well as a second retaining projection 58 is configured on the slide 32, which is displaceable relative to the first plug part 26. The replaceable return component 38 which is guided on the upper surface 36 of the first plug part 26 is secured with said retaining projections 56, 58. Moreover, clip legs 70 of the retaining clip 66 extend across the lateral cheeks of the first plug part 26 in order to lock the first plug part 26 of the combined plug module 24 to the at least one detent projection 52 on the peripheral surface 20 of the attachment component 10.

FIG. 2 shows that a semicircular collar 64 extends across the upper surface 36 of the first plug part 26.

Figure 3:
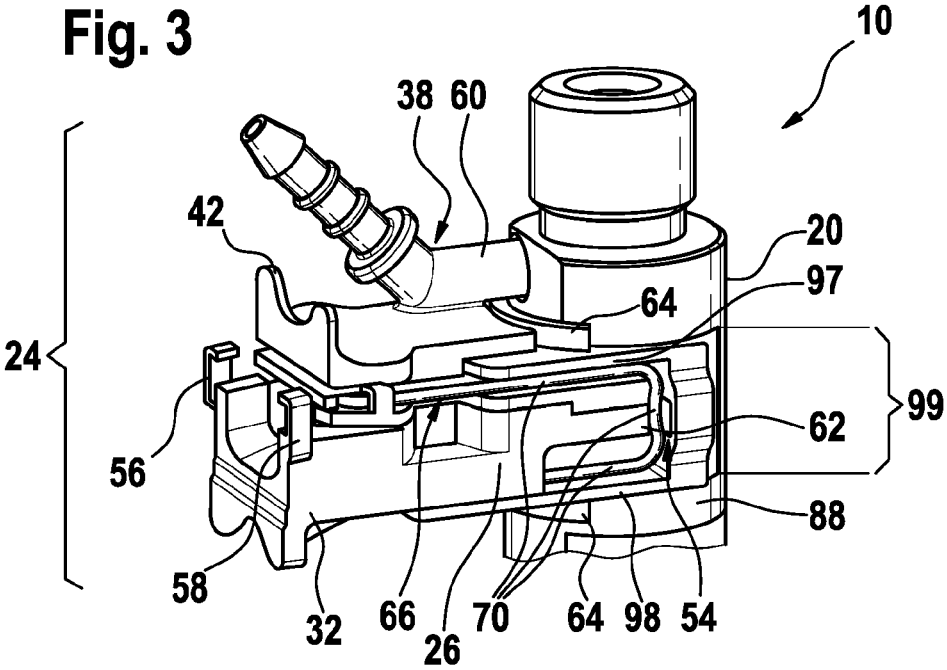
FIG. 3 is the first step of assembly, sliding the first plug part into its attachment position on the retaining body of a fuel injector.

FIG. 3 shows a first assembly step, i.e. the inserting of the inventive combined plug module into the openings of the attachment component.

FIG. 3 shows that in this state the first plug part 26 of the combined plug module 24 is inserted into the plug bore 31 depicted in FIG. 2. Plug slits 30 configured on the front end of the first plug part 26 contact electrical contacts 22, which make electrical contact inside of the attachment component 10, which relates to a fuel injector. The electrical contacting is therefore separated from the seal of a return bore 12, i.e. a separation of the electrical contacting from the fuel system exists in the return region of the attachment component 10 like, for example, a fuel injector.

It can be seen from FIG. 3 that the first plug part 26 is in fact inserted into the attachment component 10 perpendicularly to the axis of symmetry of said component 10 and that the detent projections 52 depicted in FIG. 2 engage with the attachment component 10. Said first plug part 26, however, is not yet secured to the attachment component 10. The return component 38 is inserted with its pin 60, whereupon the o-ring 46 is mounted, into the return bore 12, which is depicted in FIG. 2, in the upper region of the attachment component 10 and seals the return bore 12 and the leakage oil bore 14, which opens out into it, from leaking fuel.

FIG. 3 furthermore shows the slide 32, which can be moved relative to the plug part 26, to still be situated in a slide position "unsecured", which is denoted by reference numeral 54. As can be seen in FIG. 3, the securing lugs 62 in the forward region of the slide 32 have not yet covered the retaining clip 66 so that the first plug part 26 is in fact attached to the attachment component; however, is not yet locked.

The slide position 54 "unsecured" is thereby characterized, in that the slide 32 laterally projects beyond a handle piece 42, which is configured on the return component 38, with its front side. In the position of the slide 32 depicted in FIG. 3, its retaining projections 56 respectively 58 also do not engage with the first and the second securing lugs 57, 59, which laterally extend from the securing lug 62 and are configured below the handle piece 42 of the return component 38. This means that when the slide 32 is in the position depicted in FIG. 3, the return component 38 is also still unsecured. This is locked by the detent hook 40 with respect to the detent projection 44. In addition the pin 60 with the o-ring 46 mounted thereon is inserted in the return bore 12 and seals the same. The first plug part 26 is supported in relation to the attachment component 10 by the guide rail 99, which is joined in a recess 94 with low contact stress. In order to ensure the low contact stress despite necessary tolerances due to production technology, provision is made in each case for a prismatic upsetting edge 97, 98 on the lower and upper surface of the guide rail, which limits the amount of the contact stress through plastic deformation. FIG. 3 additionally shows that the retaining clip 66 has two clip legs 70, which run substantially parallel to each other.

Figure 4:
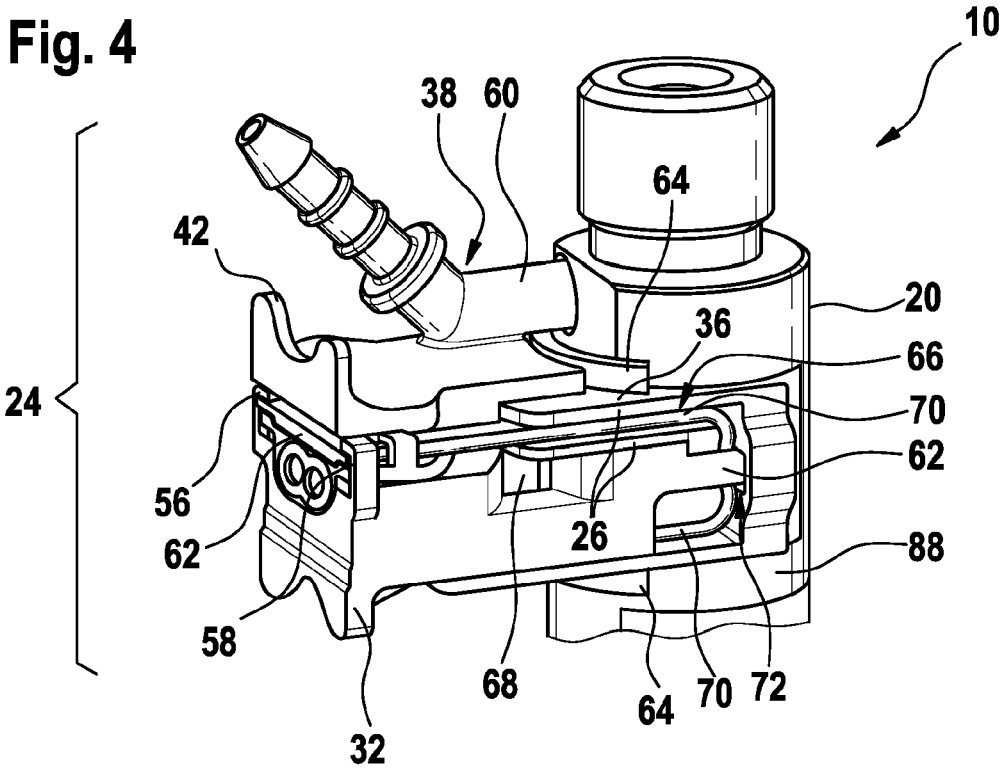
FIG. 4 is the second step of assembly, resulting from the securing of the first plug part by means of the slide and the simultaneous fixation of the return component on the upper surface of the first plug part, which serves to electrically contact the attachment component.

FIG. 4 shows an additional assembly step, namely the securing of the combined plug module according to the invention to the attachment component.

FIG. 4 shows the slide 32, which is displaceably mounted on the first plug part 26 of the combined plug module 24, pushed into the slide position 72 "secured". In the safety position 72, the slide lug 33 covers the retaining clip 66, whose clip legs 70 extend on both sides along the lateral surfaces of the first plug part 26, with its forward regions. FIG. 4 furthermore shows the securing of the first plug part 26 of the combined plug module 24 on the peripheral surface 20 of the attachment component 10 in the position of the slide 32 depicted in FIG. 4, whose retaining projections 56, 58 cover the first and second securing lugs 57, 59 on the front side of the return component 38. In the safety position 72 of the slide 32, the slide 32 therefore secures the first plug part 26 to the detent projections 52 on the peripheral surface 20 of the attachment component 10 and at the same time secures the return component 38 to the upper surface 36 of the first plug part 26.

It can furthermore be seen from FIG. 4 that recessed grips 68 are configured as to run laterally between the clip legs 70. Said grips 68 are described in more detail with reference to FIG. 6.

FIG. 4 shows that the first plug part 26 is fixed to the peripheral surface 20 of the attachment component 10 between the collars 88, 89 when said plug part 26 is in the safety position 72 "secured".

The combined plug module 24 is ready for operation in the state depicted in FIG. 4.

Figure 5:
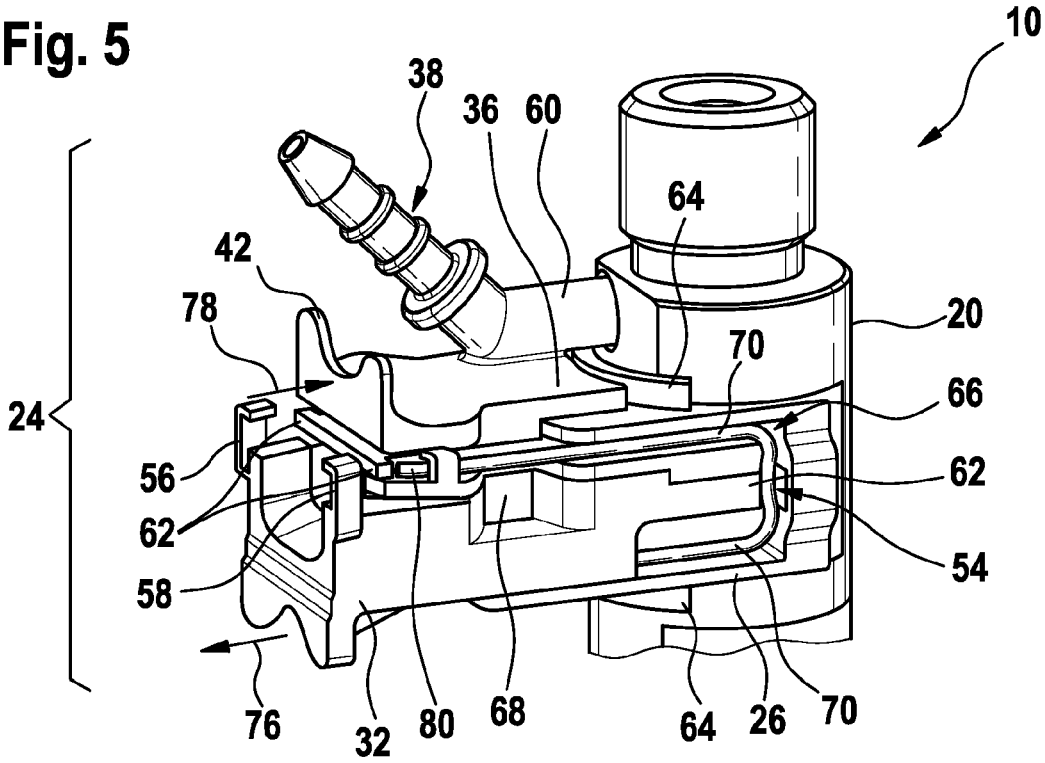
FIG. 5 is the unlocking of the return component by displacing the slide part into the position "unsecured"

FIG. 5 shows a first disassembly step of the combined plug module according to the invention.

When disassembling said plug module, the slide 32, which is displaceably mounted in the first plug part of the combined plug module 24, is pulled in the designated direction 76. At the same time a counterholding force 78 is applied to the return component 38 so that a free force does not act on the combined plug module 24.

When pulling the slide 32 in the designated direction 76, the clip legs 70 of the retaining clip 66 are released at the slide lug 33 of the slide 32. In the depiction according to FIG. 5, the slide lug 33 is situated in its retracted position, i.e. the slide 32 as such assumes the slide position 54 "Unsecured".

In this state, the first plug part 26 is inserted as before into the plug bore 31 of the attachment component 10. FIG. 5 shows that the clip legs 70 of the retaining clip 66 with their clip ends 80 end up in front of the locking lug 32 beneath the handle piece 42 of the return component 38. FIG. 5 further shows that the first and second retaining projections 56, 58 of the slide 32 release the securing lugs 57, 59 of the return component 38 in the slide position 54 "unsecured".

Figure 6:
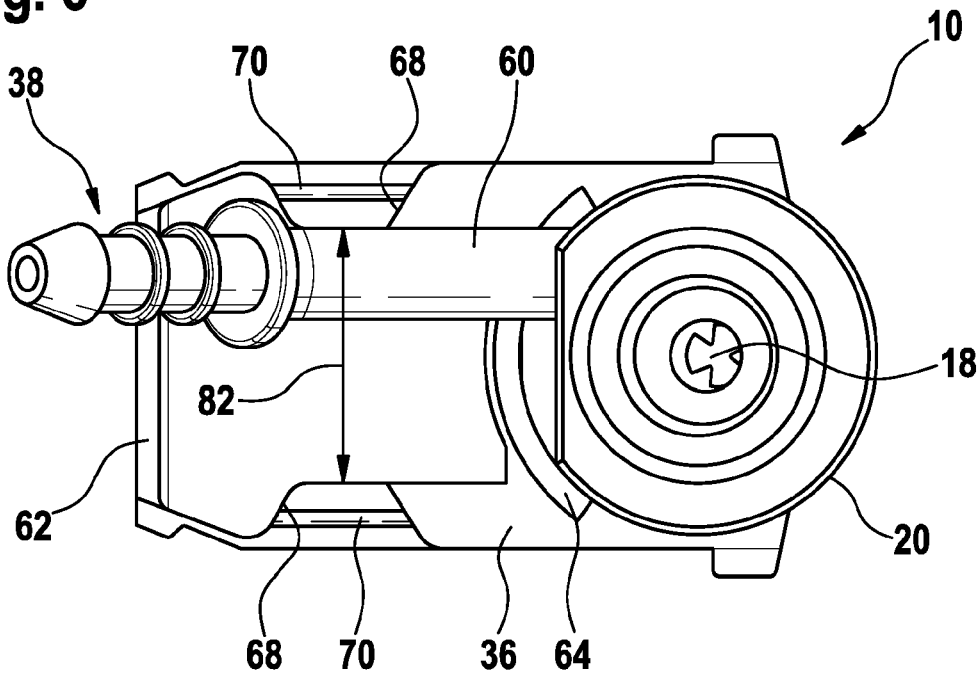
FIG. 6 is a top view of the attachment component with the return component secured to the same.

An additional, subsequent disassembly step can be seen in FIG. 6, which occurs after the slide 32 has been pulled into the position "unsecured". FIG. 6 shows that the clip legs 70 of the retaining clip 66 can be pushed into the recessed grips 68. The distance remaining between the recessed grips 68 of the combined plug module 24 constitutes a limit 82, which is measured in such a way that the retaining clip 66 is deformed to such an extent that the detent projections 52 on the attachment component 10 are not yet released. At the same time, the retaining clip ends 80 are pressed against lifting slopes 84, cf. FIGS. 7.1 and 7.2, the detent projection 40 on the lower surface of the return component 38 lifting out of its locked position (cf. FIG. 7.1) upon the retaining clip ends 80 running onto the lifting slopes 84 while being pushed along the same. While the retaining clip 66 is being compressed, the return component 38 can be taken by the handle 42 out of the attachment component 10 and off of the combined plug module 24.

Figure 7:
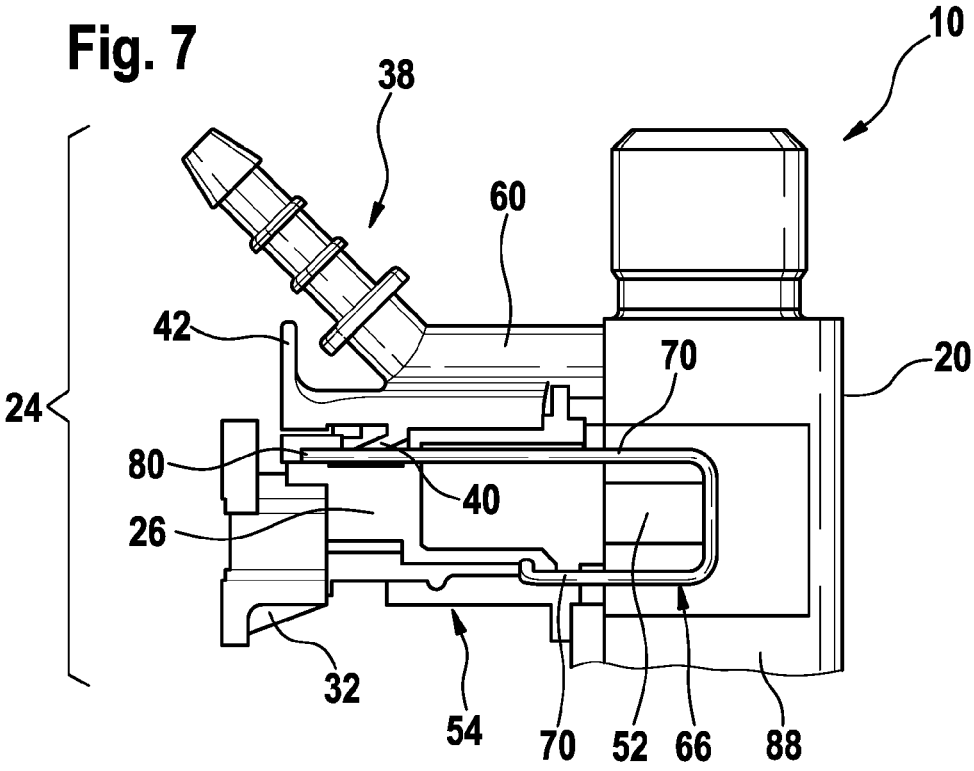
FIG. 7 is the second step of disassembly resulting from pulling the slide into the position "unsecured", FIG. 7.1 is a detailed cut-out according to FIG. 7 with respect to the clamp ends, FIG. 7.2 shows lifting slopes for unlocking the detent projection from the return component.

FIG. 7 shows that when the slide 32 is retracted, the clip legs 70 of the retaining clip 66 can be compressed in the region of the recessed grips 68. The detent projection 40 is thereby withdrawn from the upper surface 36 of the first plug part 23 because the retaining clip ends 80 are guided along the lifting slopes 84 depicted in FIGS. 7.1 and 7.2 during this deformation process. FIG. 7 shows that in the "unsecured" state via position 54 (in contrast to the depiction according to FIG. 1), the slide 32 is not engaged with its projection on its lower surface with the opening, which is provided in the first plug part 23 beneath the lower retaining clip leg 70.

Up until the return component 38 has been completely removed, the limit 82 prevents the complete actuation of the retaining clip 66 until it is in abutment in the recessed grip 68, whereby the first plug part 26 can not be unlocked. This stipulated sequence of disassembly assures that the fuel situated in the return does not flow into the plug bore 31 after the return component 38 has been detached. As a result, said fluid does not ingress into the region of the electrical contacting because the first plug part 26, which is still situated in the plug bore 31, and the plug seal 28, which is provided on said part 26, prevent such an ingress.

It can be seen from the depictions according to FIGS. 7, 7.1 and 7.2 that when the slide 32 is unlocked, the return component 38 is also unsecured and can be disassembled from the upper surface 36 of the first plug part 26 away from the attachment component 10. For that purpose, the retaining clip 66 must be actuated up to the limit 82 on the return component 38 while the handle piece 42 is simultaneously pulled.

Because the first plug part 26 is still mounted in the plug bore 31 of the attachment component 10 in this stage of disassembly, no fuel can enter into the electrical contacting of the attachment component 10 during disassembly of the return component 38 after the slide 32 has been unlocked. This is a result of said contacting being sealed off from the fuel by the plug seal 28 on the end of the first plug part 26 facing the attachment components 10.

Figure 8:
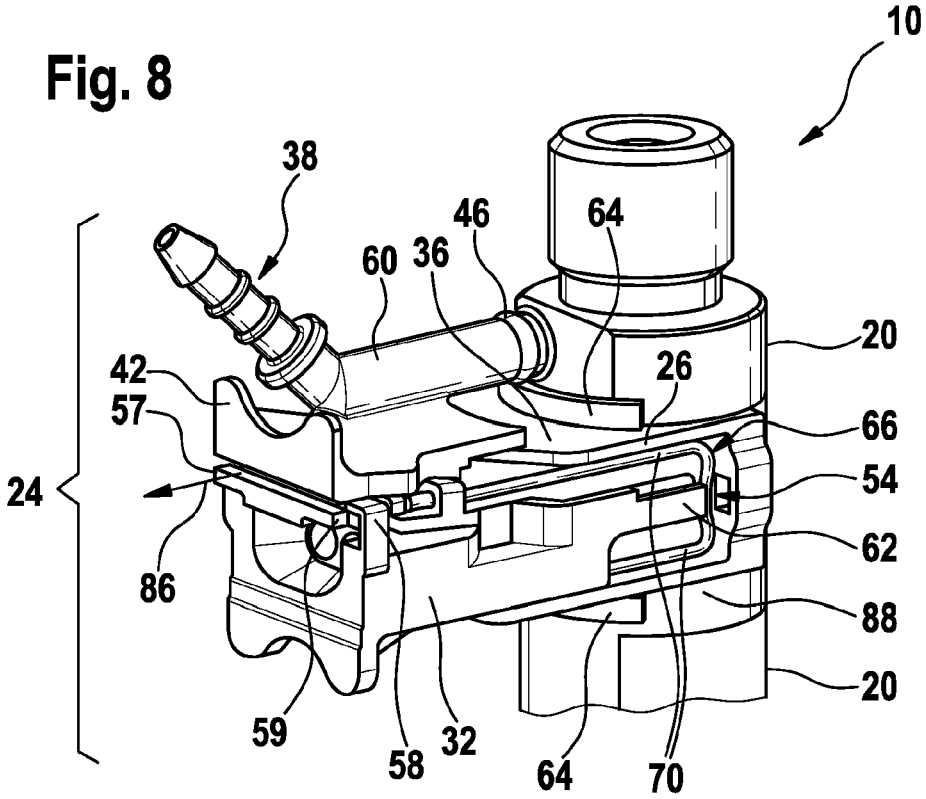
FIG. 8 is an additional third assembly step resulting from detaching the return component.

FIG. 8 shows a further disassembly step of the combined plug module from the attachment component.

FIG. 8 shows that the slide 32 has released the retaining clip 66 with its slide lug 33. Although the securing lugs 57, 59 periodically cover the retaining projections 56, 58 when the return component 38 is being detached, the complete removal of said component 38 is possible because the detent hook 40 is already disengaged from the detent projection 44 at this position.

For this reason, the return component 38 can be taken out of the return bore 12, in which the leakage oil bore 14 opens out. Because the plug body of the first plug part 26 is mounted as before in the plug bore 31 of the attachment component 10, leaking fuel cannot enter into the region of the electrical contacting of the attachment component when the return component 38 is being disassembled. This results from said contacting being sealed off from the fuel by the plug seal 28 and the first plug part 26 being situated in the plug bore 31. By means of the position 54 of the slide 32 and the associated release of the return component 38 at the locking lug 32, said component 38 can be detached from the upper surface 36 of the first plug part 26 of the combined plug module 24 in the removal direction 86.

Figure 9:
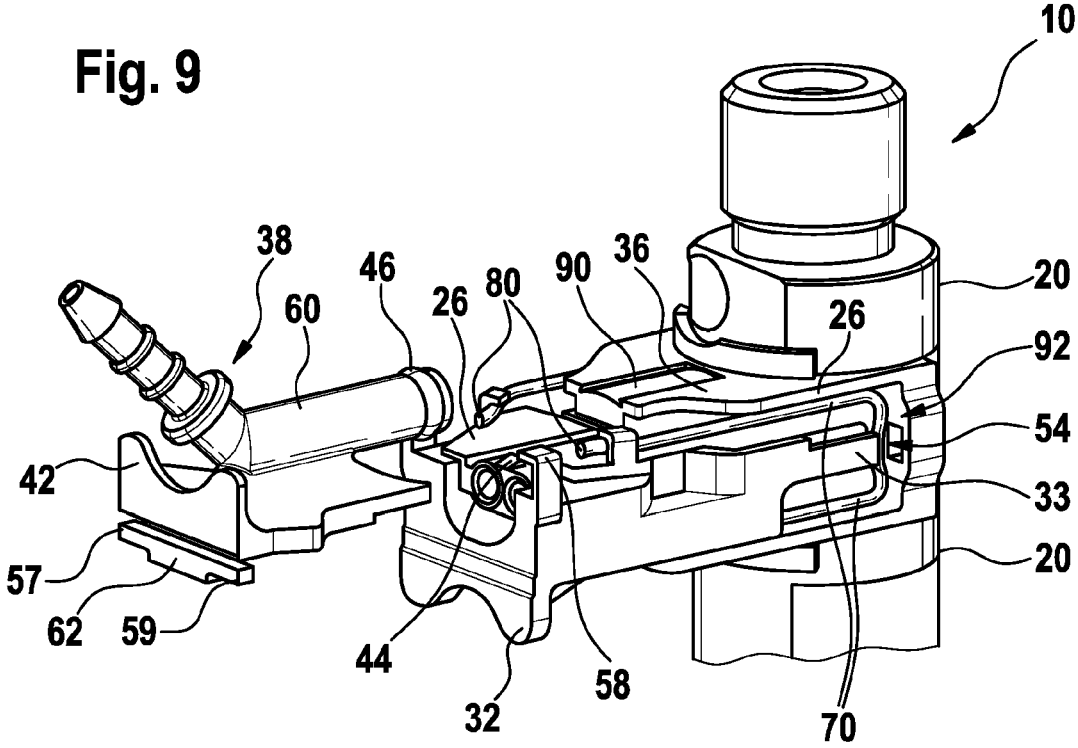
FIG. 9 is the removal of the return component from the upper surface of the first plug part, which serves to electrically contact the attachment component and has a dovetail guide.

FIG. 9 shows that a guide 90, which, for example, can be constructed as a dovetail guide, is configured in the upper surface 36 of the first plug part 26 of the combined plug module 24 according to the invention. The return component 38 is inserted with its lower surface into this guide on the upper surface 36 of the first plug part 26. In the positions of the slide 32 depicted in FIGS. 8 and 9 and in those of the already partially, respectively completely, retracted return component 36 depicted there, the locking engagement of the return component 38 is released so that the return component 38—as indicated in FIG. 8—can be withdrawn in the removal direction 86 out of guide 90, which is constructed, for example, as a dovetail, on the upper surface. After the disassembly of the return component 38, as depicted in FIG. 9, its pin 60 with the o-ring 46 mounted thereon is removed from the return bore 12. After the return component 38 has been removed, as depicted in FIG. 9, the clip legs 70 can be compressed (now that the limit 82 has been removed) to the extent that the clip legs 70 of the retaining clip 66 release the detent projections 52 in the flattened portions on the peripheral surface 20 of the attachment component 10. The first plug part 26 of the combined plug module 24 can also now be withdrawn from the plug bore 31 of the attachment component 10.

In the unlocked position 92 of the locking lugs 62 of the slide 32, which is depicted in FIG. 9, the first plug part 26 of the combined plug module 24 can be removed from the plug bore 31 of the attachment component 10. This procedure is only possible after the return component 38 has previously been disassembled. Said attachment component 10 is thus protected from ingressing fuel as long as the first plug part 26 with the plug seal 28 mounted thereon remains in the plug bore 31.

The stipulated sequence according to the invention for the disassembly of the combined plug module 24 from the attachment component 10 assures that the fuel situated in the low pressure region, respectively return region, does not ingress into the plug bore 31 and flow into the plug contact region after withdrawing the return element 38 in the removal direction 86. The first plug part 26 with the plug seal 28 mounted thereon prevents this ingress of fuel.

Figure 10:
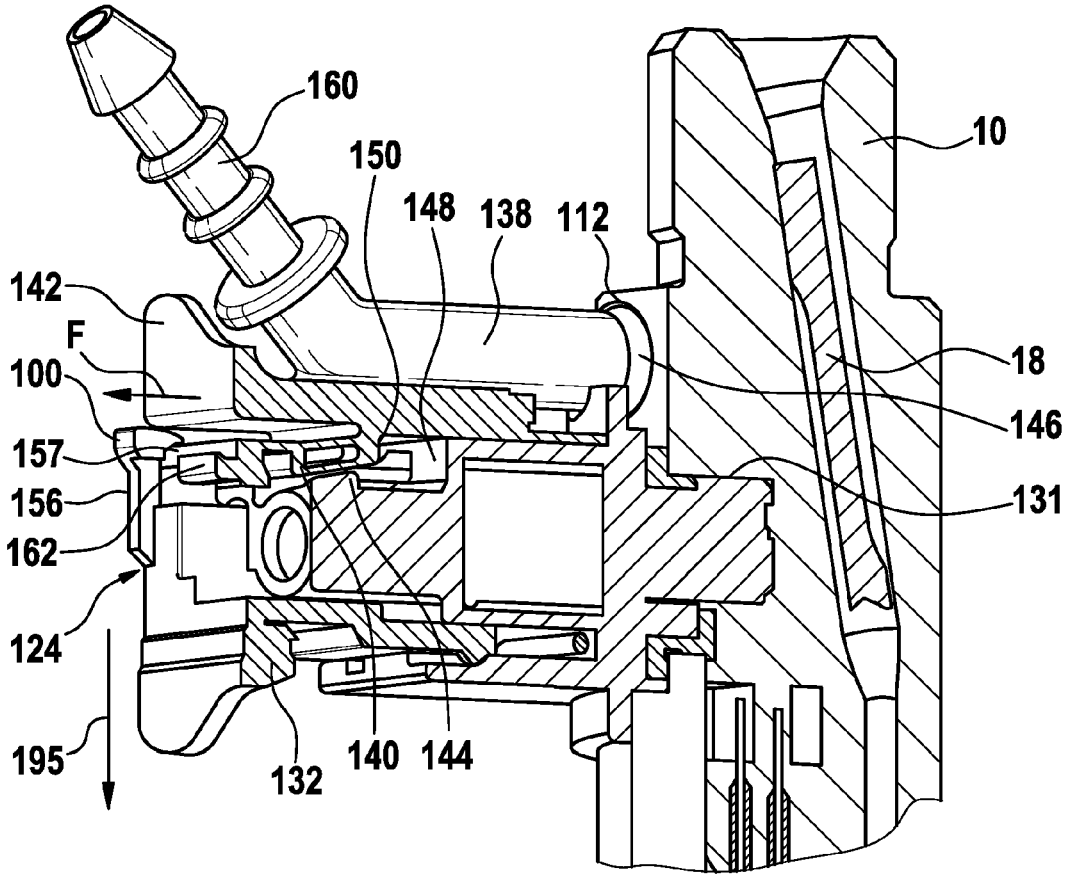
FIG. 10 is a combined plug module as an embodiment option with an intermediate detent limit stop for the return component, FIGS. 10.1 and 10.2 is the plug module in the secured and ready-to-operate state, FIGS. 11.1 and 11.2 the slide depicted in the unsecured position, FIGS. 12.1 and 12.2 is the plug module in the unsecured state, wherein the plug and return component are locked.

FIG. 10 shows a combined plug module as an embodiment with an intermediate limit stop of the return component.

An embodiment, wherein the plug module 124, respectively its slide 132, has axial detent limit stops 100, 101 on the upper ends of the retaining projections 156, 158. The return component 138 rests on said plates 156, 158 when it is refracted in an intermediate detent position 102. In the intermediate detent position 102, a pin 160 is retracted to such an extent that an o-ring 146 from the return bore 112 loses contact, and the fuel situated in the return, can flow out. Said fuel does not, however, move into the plug bore 131 because said bore 131 is closed attributable to positive flow. The limit of the actuating stroke travel 182 is constituted with respect to the length dimension in such a way that the retaining clip 66 can just now be completely actuated in the intermediate detent position 102. The intermediate detent position 102 assures that the return component 138 is unlocked by pressing on the locking lug 162 and that the return component 138 can be lifted off from the first plug part 124 when the handle piece 142 is simultaneously pulled. The combined plug module 124 can be disassembled and assembled as one piece by means of the intermediate detent position 102 without having to lift off the return component 138 and reinsert it into the guide 190, which, for example, can be designed as a dovetail guide.

The complete disassembly of the plug module 124 can selectively occur in two parts, as in the basic embodiment, or in one part. In the case of the two-parted disassembly, the securing lug 162 is actuated in the removal direction so that the securing lug extensions 157, 159 disengage from the axial detent limit stops 100, 101. When the handle piece is pulled at the same time, the return component 138 can be withdrawn from the first plug part 126. The further disassembly takes place as described in context with the basic embodiment.

In the case of the one-parted disassembly, the limit of the actuating stroke travel 182 is constituted with respect to the length dimension in such a way that the retaining clip 66 can just now be completely actuated in the intermediate detent position 102. When the retaining clip 166 is fully actuated and the handle piece of the return component 138 and/or the slide 132 is simultaneously pulled, the plug module 124 can be taken off as a whole from the attachment component 10.

By displacing the slide 132 as well as the return component 138, the actuating states of a retaining clip 166 in relation to the recessed grip 168, which are depicted in the FIGS. 10.1, 10.2, 11.1, 11.2, 12.1 and 12.2, can be represented.

In FIGS. 10.1 and 10.2, the combined plug module 124 is depicted in the ready-to-operate state. An actuation of the retaining clip 166 is prevented by the actuator limit 183 on the slide 132.

In FIGS. 11.1 and 11.2 the slide is depicted in the unsecured position. An actuation of the retaining clip 166 is thereby prevented by the actuator limit 183 on the return component 138, whereby only the return component 138 can itself be unlocked.

In FIGS. 12.1 and 12.2, the return component 138 is placed into an intermediate detent position. In said position, the retaining clip 166 can be actuated up to the recessed grip 168, whereby the first plug part 124 can be completely unlocked.

When assembling the combined plug module 124, the contacting of the electrical contacts can simultaneously occur with the sealing up of the return component 138 or optionally in a reverse order of disassembly in order, for example, to reduce the insertion forces, respectively to allow for assembly when the bores are not embodied parallel to each other.

The invention claimed is:

1. Plug module arranged on a fuel injector for installation in the cylinder head region of an internal combustion engine, that is supplied with fuel via a fuel injection system having a low-pressure region, wherein the plug module is a combined plug module including a first plug part configured to provide electrical contact and a replaceable return component configured to remove a fluid from the fuel injector, wherein the plug module encloses the first plug part and the replaceable return component is detachably mounted on the first plug part.

2. The plug module according to claim 1, wherein a slide can be moved on the first plug part for locking and unlocking the same.

3. The plug module according to claim 1, wherein the slide locks the first plug part to the fuel injector in a safety position, wherein the replaceable return component for removing a fluid from the fuel injector is locked in its contact position in the fuel injector at the same time.

4. The plug module according to claim 1, wherein in an unlocked position of the slide on the first plug part, the replaceable return component is in turn unsecured.

5. The plug module according to claim 4, wherein the replaceable return component for removing a fluid from the fuel injector is guided in a guide on an upper surface of the first plug part.

6. The plug module according to claim 1, wherein the slide has at least one retaining projection, with which securing lugs or their extensions of the return component are engaged and secured in the safety position of the slide.

7. The plug module according to claim 1, wherein the replaceable return component has a pin, which has a seal on the end contacting the attachment component.

8. The plug module according to claim 1, wherein the first plug part has a retaining clip with clip legs extending across the lateral cheeks of the first plug part.

9. The plug module according to claim 8, wherein the return component for removing a fluid from the fuel injector forms a limit of an actuating stroke travel for the retaining clip in such a way that after removing the return component from the first plug part, said plug part can be detached from the fuel injector by unlocking the detent projections of said attachment component.

10. The plug module according to claim 1, wherein a detent projection is resiliently configured on the lower surface of the return component, wherein said projection interacts with a detent projection, which corresponds thereto, on the upper surface of the first plug part, wherein the former projection and the latter projection can be disengaged when the clip deforms as a result of the retaining clip ends, which extend along lifting slopes, engaging in recessed grips.

* * * * *